US012808159B2

(12) United States Patent
Yokoo et al.

(10) Patent No.: US 12,808,159 B2
(45) Date of Patent: Nov. 24, 2026

(54) DISPLAY SYSTEM OF WORK MACHINE, WORK MACHINE, AND DISPLAY METHOD OF WORK MACHINE

(71) Applicant: KOMATSU LTD., Tokyo (JP)

(72) Inventors: Takashi Yokoo, Tokyo (JP); Ryohei Hasegawa, Tokyo (JP); Yoshito Kumakura, Tokyo (JP); Kazuya Onda, Tokyo (JP); Kenichi Tsunoda, Tokyo (JP); Yasufumi Uehara, Tokyo (JP)

(73) Assignee: KOMATSU LTD., Tokyo (JP)

( * ) Notice: Subject to any disclaimer, the term of this patent is extended or adjusted under 35 U.S.C. 154(b) by 117 days.

(21) Appl. No.: 18/851,882

(22) PCT Filed: Aug. 31, 2023

(86) PCT No.: PCT/JP2023/031778
§ 371 (c)(1),
(2) Date: Sep. 27, 2024

(87) PCT Pub. No.: WO2024/048711
PCT Pub. Date: Mar. 7, 2024

(65) Prior Publication Data

US 2025/0207367 A1 Jun. 26, 2025

(30) Foreign Application Priority Data

Aug. 31, 2022 (JP) ..... 2022-138621

(51) Int. Cl.
*E02F 9/26* (2006.01)
*E02F 9/20* (2006.01)

(52) U.S. Cl.
CPC ..... *E02F 9/261* (2013.01); *E02F 9/2033* (2013.01)

(58) Field of Classification Search
CPC .... E02F 9/261; E02F 9/2033; G04F 3/04847; G04F 3/14
See application file for complete search history.

(56) References Cited

U.S. PATENT DOCUMENTS

2010/0042940 A1* 2/2010 Monday ..... G09B 29/106 715/764
2019/0003155 A1* 1/2019 Kurogi ..... B60R 1/28
(Continued)

FOREIGN PATENT DOCUMENTS

EP 4 198 206 A1 6/2023
KR 10-2020-0132891 A 11/2020
(Continued)

OTHER PUBLICATIONS

International Search Report for the corresponding international patent application No. PCT/JP2023/031778, issued on Oct. 24, 2023.
(Continued)

*Primary Examiner* — Antonio A Caschera
(74) *Attorney, Agent, or Firm* — Spencer Fane LLP

(57) ABSTRACT

A display system of a work machine includes a construction data storage unit that stores an existing virtual wall indicating a virtual wall set at a work site of the work machine, the virtual wall restricting entry of the work machine; a virtual wall setting unit that sets a new virtual wall indicating a virtual wall to be newly added; and a display control unit that causes a display device to display each of the existing virtual wall and the new virtual wall.

13 Claims, 12 Drawing Sheets

[FIRST CREATION SCREEN]

(56) References Cited

U.S. PATENT DOCUMENTS

| | | | | |
|---|---|---|---|---|
| 2020/0291614 | A1* | 9/2020 | Kiyota | B60R 1/23 |
| 2021/0002863 | A1 | 1/2021 | Sakuta et al. | |
| 2021/0010236 | A1 | 1/2021 | Nishi | |
| 2021/0230841 | A1* | 7/2021 | Kurosawa | E02F 9/2033 |
| 2022/0070611 | A1* | 3/2022 | Ready-Campbell | G08G 1/0968 |

FOREIGN PATENT DOCUMENTS

| | | | |
|---|---|---|---|
| WO | 2019/189030 | A1 | 10/2019 |
| WO | 2019/189203 | A1 | 10/2019 |
| WO | 2020/012609 | A1 | 1/2020 |
| WO | 2022/163322 | A1 | 8/2022 |

OTHER PUBLICATIONS

A Office Action for the corresponding Korean Patent Application No. 10-2024-7032990; issued Dec. 17, 2025.

* cited by examiner

[FIRST CREATION SCREEN]

[FIRST CREATION SCREEN]

[SECOND CREATION SCREEN]

[SECOND CREATION SCREEN]

DISPLAY SYSTEM OF WORK MACHINE, WORK MACHINE, AND DISPLAY METHOD OF WORK MACHINE

CROSS-REFERENCE TO RELATED APPLICATIONS

This application is a U.S. National stage application of International Application No. PCT/JP2023/031778, filed on Aug. 31, 2023. This U.S. National stage application claims priority under 35 U.S.C. § 119(a) to Japanese Patent Application No. 2022-138621, filed in Japan on Aug. 31, 2022, the entire contents of which are hereby incorporated herein by reference.

The present disclosure relates to a display system of a work machine, the work machine, and a display method of the work machine.

BACKGROUND

At a work site of a work machine, there may be an avoidance area in which the work machine should be prevented from entering. When the work machine enters the avoidance area, there is a possibility that a work efficiency of the work machine deteriorates. WO 2020/012609 A discloses a work machine capable of easily preventing a vehicle main body or a work device from coming into contact with surrounding obstacles.

SUMMARY

Since a virtual wall that restricts entry of a work machine is set at a work site, it is possible to suppress the work machine from entering an avoidance area. Depending on a situation of the work site, it may be desired to add a new virtual wall to an existing virtual wall.

An object of the present disclosure is to easily set a virtual wall.

In order to achieve an aspect of the present invention, a display system of a work machine, the display system comprises: a construction data storage unit that stores an existing virtual wall indicating a virtual wall set at a work site of the work machine, the virtual wall restricting entry of the work machine; a virtual wall setting unit that sets a new virtual wall indicating a virtual wall to be newly added; and a display control unit that causes a display device to display each of the existing virtual wall and the new virtual wall.

According to the present disclosure, a virtual wall is easily set.

DESCRIPTION OF EMBODIMENTS

Hereinafter, embodiments according to the present disclosure will be described with reference to the drawings, but the present disclosure is not limited to the embodiments. The components of the embodiments described below can be appropriately combined with each other. In addition, some components may not be used.

Work Machine

Figure 1:
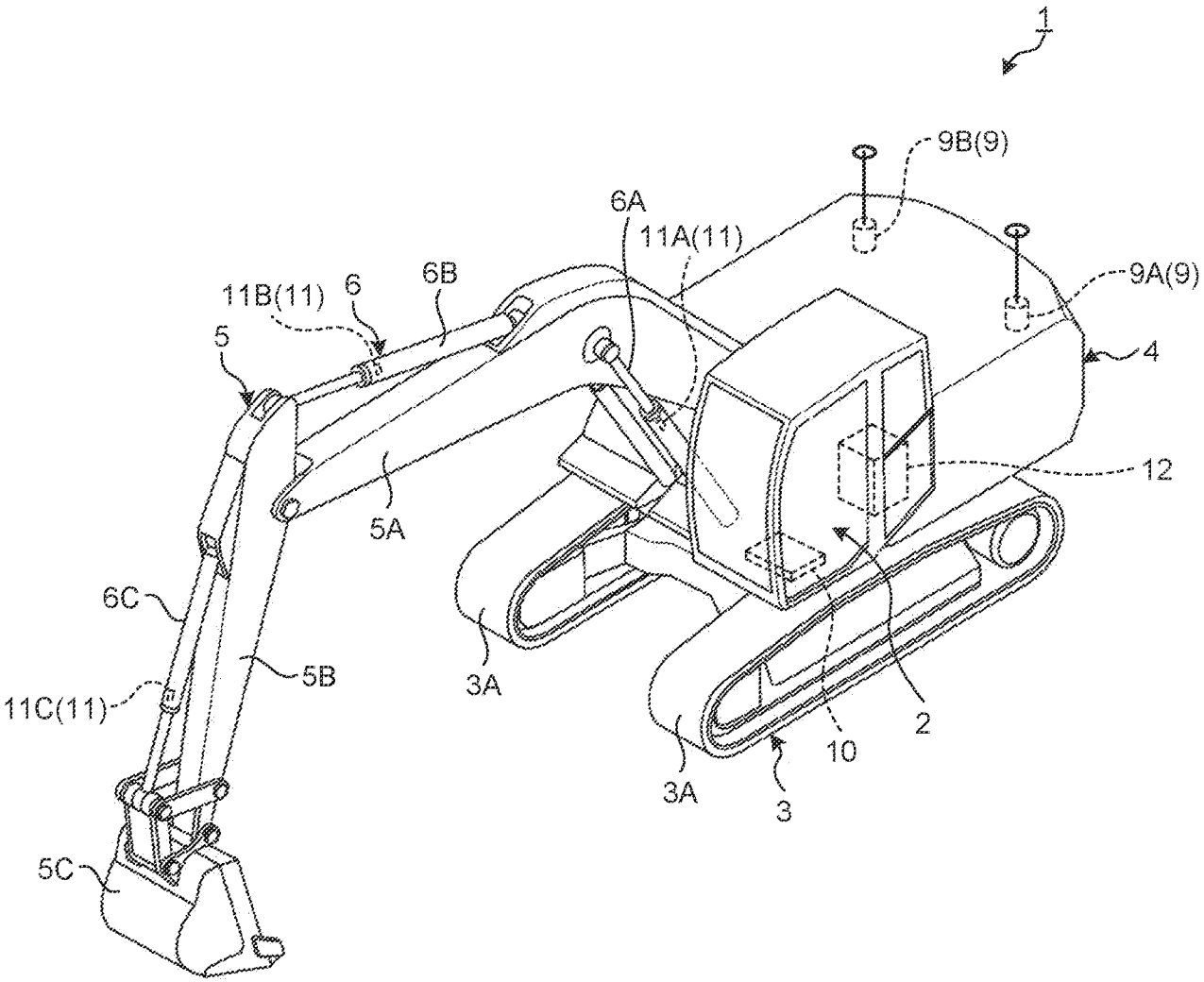
FIG. 1 is a perspective view illustrating a work machine according to an embodiment.
Figure 2:
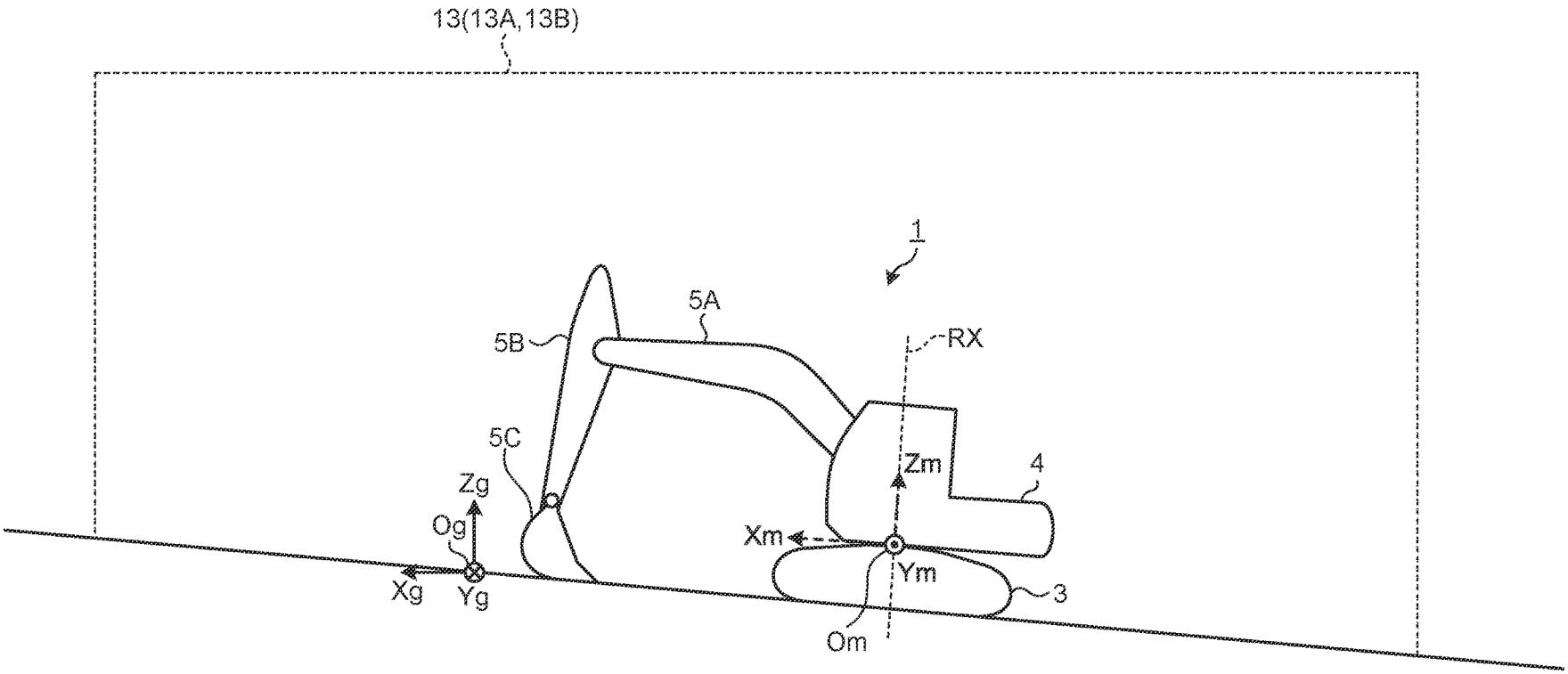
FIG. 2 is a schematic diagram illustrating the work machine according to the embodiment.
Figure 3:
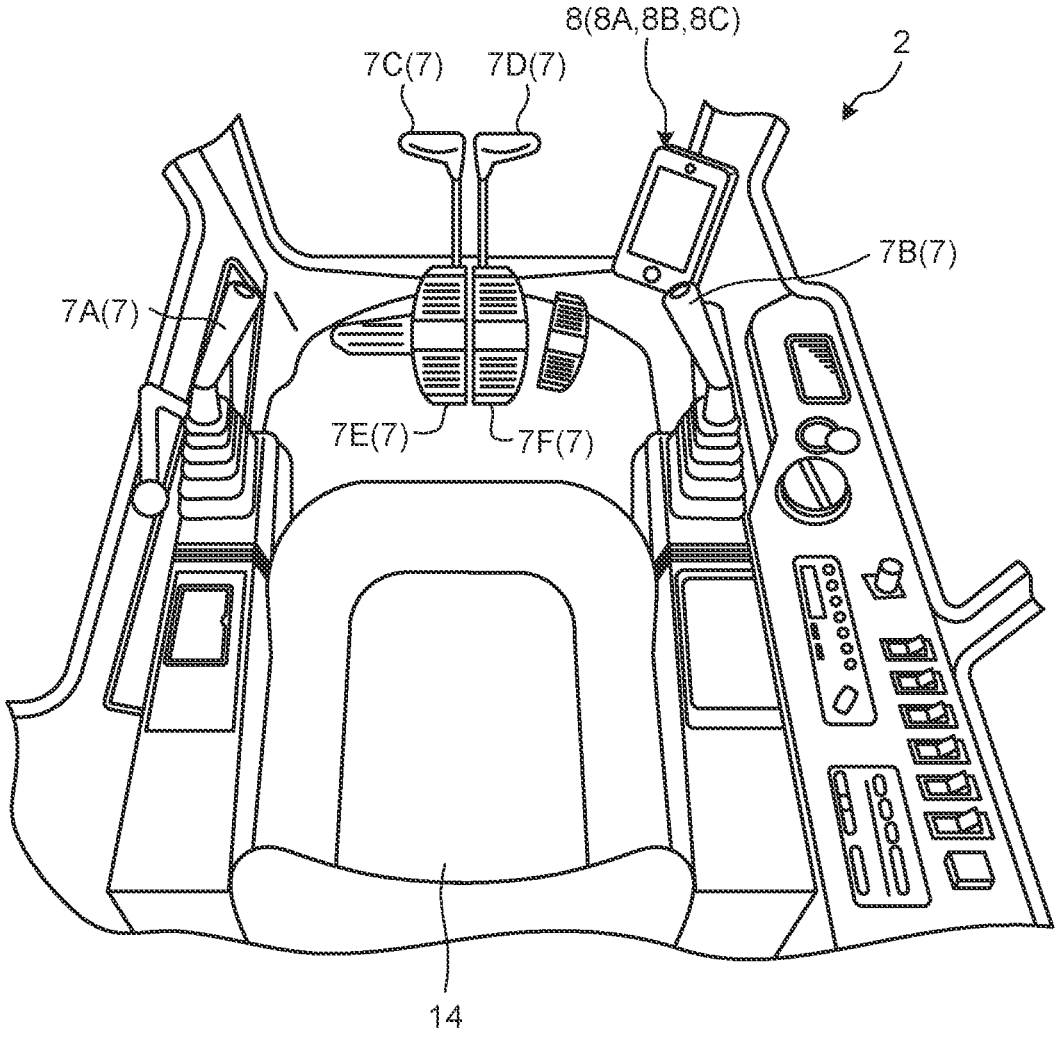
FIG. 3 is a diagram illustrating a cab of the work machine according to the embodiment.

FIG. 1 is a perspective view illustrating a work machine 1 according to an embodiment. FIG. 2 is a schematic diagram illustrating the work machine 1 according to the embodiment. FIG. 3 is a diagram illustrating a cab 2 of the work machine 1 according to the embodiment.

The work machine 1 is operated at a work site. In the embodiment, the work machine 1 is an excavator. In the following description, the work machine 1 is appropriately referred to as an excavator 1.

The excavator 1 includes a traveling body 3, a swing body 4, working equipment 5, a hydraulic cylinder 6, an operating device 7, an in-vehicle monitor 8, a position sensor 9, an inclination sensor 10, a posture sensor 11, and a control device 12.

As illustrated in FIG. 2, a three-dimensional site coordinate system (Xg, Yg, Zg) is defined at the work site. A three-dimensional vehicle body coordinate system (Xm, Ym, Zm) is defined in the swing body 4.

The site coordinate system is configured by an Xg axis extending from a site reference point Og defined at the work site to the north and south, a Yg axis extending from the site reference point Og to the east and the west, and a Zg axis extending vertically from the site reference point Og.

The vehicle body coordinate system is configured by an Xm axis extending in the forward-and-rearward direction of the swing body 4 from a representative point Om defined in the swing body 4, a Ym axis extending in the left-and-right direction of the swing body 4 from the representative point Om, and a Zm axis extending in the upward-and-downward direction of the swing body 4 from the representative point Om. With reference to the representative point Om of the swing body 4, the +Xm direction is the front side of the swing body 4, the −Xm direction is the rear side of the swing body 4, the +Ym direction is the left side of the swing body 4, the −Ym direction is the right side of the swing body 4, the +Zm direction is the upper side of the swing body 4, and the −Zm direction is the lower side of the swing body 4.

In addition, a virtual wall 13 is set at the work site. The virtual wall 13 is a virtual wall that restricts entry of the excavator 1. The virtual wall 13 is set to surround the excavator 1. The virtual wall 13 is set in the site coordinate system. The virtual wall 13 is set to each of the south side, the north side, the east side, the west side, the upper side, and the lower side of the excavator 1. Note that the virtual wall 13 may be set to at least one of the south side, the north side, the east side, the west side, the upper side, and the lower side of the excavator 1. Even if the excavator 1 moves at the work site, the virtual wall 13 does not move. The virtual wall 13 is fixed to the work site. The outside of the virtual wall 13 is an avoidance area where entry of the work machine is to be avoided. When the excavator 1 approaches the virtual wall 13, the movement of at least one of the traveling body 3, the swing body 4, and the working equipment 5 is restricted, or an alarm is output in the cab 2.

There is a possibility that an obstacle that hinders the work of the excavator 1 exists at the work site. Examples of the obstacle include an electric wire present above the excavator 1, a cliff or a hole present at the work site, and a building. The avoidance area is, for example, an area where an obstacle exists. When the excavator 1 enters the avoidance area, there is a possibility that the work efficiency of the excavator 1 deteriorates. By setting the virtual wall 13 at a boundary between the work area in which the excavator 1 works and the avoidance area, the excavator 1 is suppressed from entering the avoidance area beyond the virtual wall 13. As a result, deterioration in work efficiency of the excavator 1 is suppressed.

The traveling body 3 travels while supporting the swing body 4. The traveling body 3 includes a pair of crawler belts 3A. By the rotation of the crawler belts 3A, the traveling body 3 performs traveling movement. The traveling movement of the traveling body 3 includes forward movement and rearward movement. The excavator 1 can move within the work site by the traveling body 3.

The swing body 4 is supported by the traveling body 3. The swing body 4 is disposed above the traveling body 3. The swing body 4 performs swing movement around a swing axis RX while being supported by the traveling body 3. The swing axis RX is parallel to the Zm axis. The swing movement of the swing body 4 includes a left swing movement and a right swing movement. The cab 2 is provided in the swing body 4.

The working equipment 5 is supported by the swing body 4. The working equipment 5 performs work. In the embodiment, the work performed by the working equipment 5 includes excavation work of excavating an excavation object and loading work of loading an excavated object onto a loading object.

The working equipment 5 includes a boom 5A, an arm 5B, and a bucket 5C. The proximal end portion of the boom 5A is rotatably connected to a front portion of the swing body 4. The proximal end portion of the arm 5B is rotatably connected to the distal end portion of the boom 5A. The proximal end portion of the bucket 5C is rotatably connected to the distal end portion of the arm 5B.

The hydraulic cylinder 6 causes the working equipment 5 to move. The hydraulic cylinder 6 includes a boom cylinder 6A, an arm cylinder 6B, and a bucket cylinder 6C. The boom cylinder 6A causes the boom 5A to perform a raising movement and a lowering movement. The arm cylinder 6B causes the arm 5B to perform an excavation movement and a dumping movement. The bucket cylinder 6C causes the bucket 5C to perform the excavation movement and the dumping movement. The proximal end portion of the boom cylinder 6A is connected to the swing body 4. The distal end portion of the boom cylinder 6A is connected to the boom 5A. The proximal end portion of the arm cylinder 6B is connected to the boom 5A. The distal end portion of the arm cylinder 6B is connected to the arm 5B. The proximal end portion of the bucket cylinder 6C is connected to the arm 5B. The distal end portion of the bucket cylinder 6C is connected to the bucket 5C.

As illustrated in FIG. 3, the operating device 7 is disposed in the cab 2. The operating device 7 is operated to cause at least one of the traveling body 3, the swing body 4, and the working equipment 5 to move. The operating device 7 is operated by an operator in the cab 2. The operator can operate the operating device 7 while sitting on a driver seat 14 disposed in the cab 2.

The operating device 7 includes a left working lever 7A and a right working lever 7B operated for the movement of the swing body 4 and the working equipment 5, a left traveling lever 7C and a right traveling lever 7D operated for the movement of the traveling body 3, and a left foot pedal 7E and a right foot pedal 7F.

When the left working lever 7A is operated in the forward-and-rearward direction, the arm 5B performs the dumping movement or the excavation movement. When the left working lever 7A is operated in the left-and-right direction, the swing body 4 performs the left swing movement or the right swing movement. When the right working lever 7B is operated in the left-and-right direction, the bucket 5C performs the excavation movement or the dumping movement. When the right working lever 7B is operated in the forward-and-rearward direction, the boom 5A performs the lowering movement or the raising movement. Note that the swing body 4 may perform the left swing movement or the right swing movement when the left working lever 7A is operated in the forward-and-rearward direction, and the arm 5B may perform the dumping movement or the excavation movement when the left working lever 7A is operated in the left-and-right direction.

When the left traveling lever 7C is operated in the forward-and-rearward direction, the crawler belt 3A on the left side of the traveling body 3 performs the forward movement or the rearward movement. When the right traveling lever 7D is operated in the forward-and-rearward direction, the crawler belt 3A on the right side of the traveling body 3 performs the forward movement or the rearward movement.

The left foot pedal 7E is operated in conjunction with the left traveling lever 7C. The right foot pedal 7F is operated in conjunction with the right traveling lever 7D. The traveling body 3 may perform the forward movement or the rearward movement by operating the left foot pedal 7E and the right foot pedal 7F.

The in-vehicle monitor 8 is disposed in the cab 2. The in-vehicle monitor 8 is disposed on the right front side of the driver seat 14. The in-vehicle monitor 8 includes a display device 8A, an input device 8B, and an alarm device 8C.

The display device 8A displays prescribed display data. As the display device 8A, a flat panel display, such as a liquid crystal display (LCD) or an organic electroluminescence display (OELD), is exemplified.

The input device 8B generates input data by being operated by the operator. Examples of the input device 8B include a button switch, a computer keyboard, and a touch panel.

The alarm device 8C outputs a prescribed alarm. In the embodiment, the alarm device 8C is a sound output device that outputs an alarm sound. Note that the alarm device 8C may be a light emitting device that outputs alarm light.

The position sensor 9 detects the position of the swing body 4 in the site coordinate system. The position sensor 9 detects the position of the swing body 4 in the site coordinate system using a global navigation satellite system (GNSS). The global navigation satellite system includes a global positioning system (GPS). The global navigation satellite system detects a position defined by coordinate data of latitude, longitude, and altitude. The position sensor 9 includes a GNSS receiver that receives GNSS radio waves from a GNSS satellite. The position sensor 9 is disposed in the swing body 4. In the embodiment, the position sensor 9 is disposed in a counterweight of the swing body 4.

The position sensor 9 includes a first position sensor 9A and a second position sensor 9B. The first position sensor 9A and the second position sensor 9B are disposed at different positions in the swing body 4. In the embodiment, the first position sensor 9A and the second position sensor 9B are disposed at intervals in the left-and-right direction in the swing body 4. The first position sensor 9A detects a first measured position indicating a position in which the first position sensor 9A is disposed. The second position sensor 9B detects a second measured position indicating a position in which the second position sensor 9B is disposed.

The inclination sensor 10 detects acceleration and angular velocity of the swing body 4. The inclination sensor 10 includes an inertial measurement unit (IMU). The inclination sensor 10 is disposed in the swing body 4. In the embodiment, the inclination sensor 10 is installed below the cab 2.

The posture sensor 11 detects the posture of the working equipment 5. The posture of the working equipment 5 includes an angle of the working equipment 5. The posture sensor 11 includes a first posture sensor 11A that detects an angle of the boom 5A relative to the swing body 4, a second posture sensor 11B that detects an angle of the arm 5B relative to the boom 5A, and a third posture sensor 11C that detects an angle of the bucket 5C relative to the arm 5B. The posture sensor 11 may be a stroke sensor that detects a stroke of the hydraulic cylinder 6 or a potentiometer that detects the angle of the working equipment 5.

Control System

Figure 4:
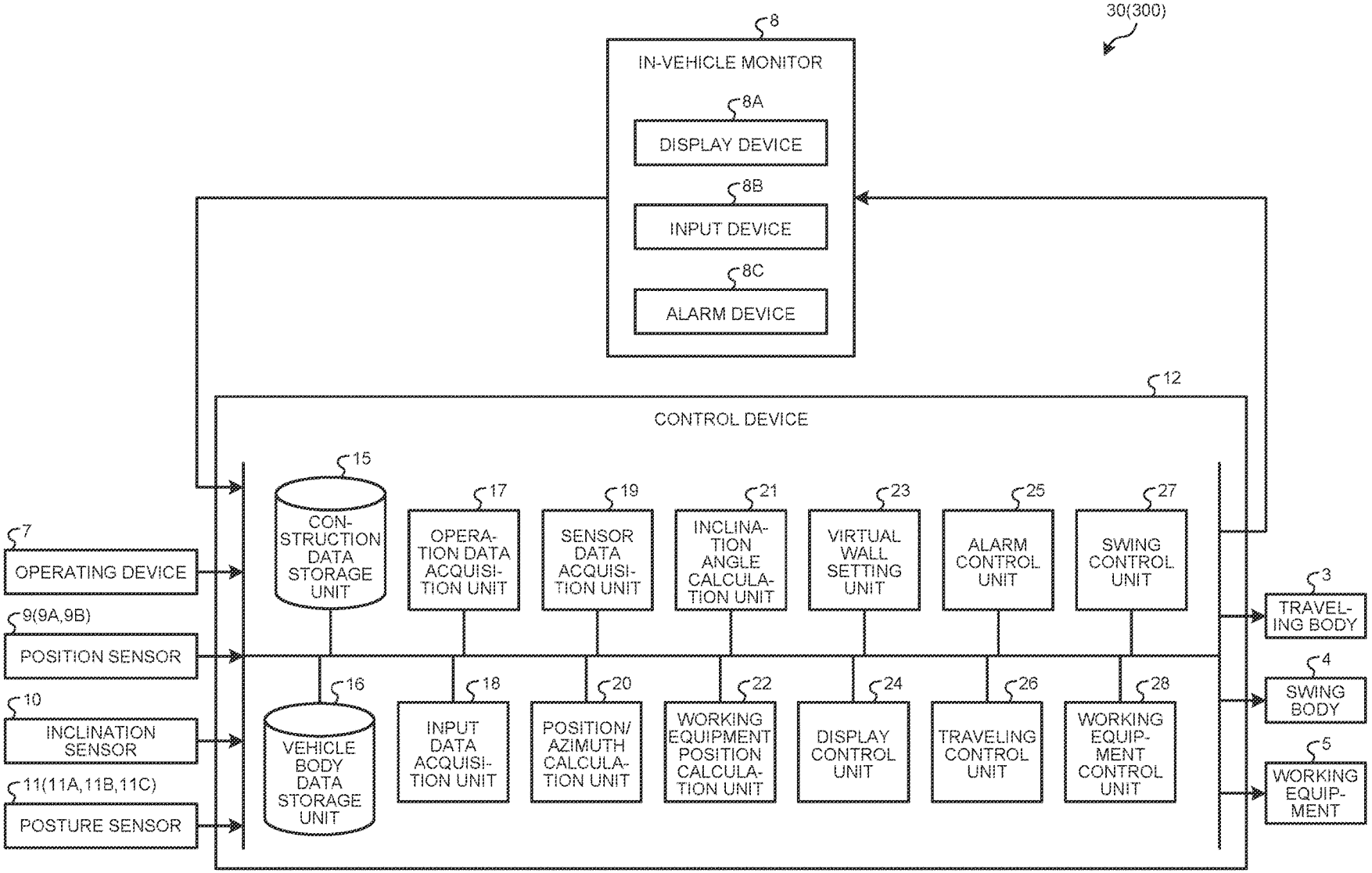
FIG. 4 is a block diagram illustrating a control system of the work machine according to the embodiment.

FIG. 4 is a block diagram illustrating a control system 30 of the work machine 1 according to the embodiment. The excavator 1 includes the control system 30. The control system 30 includes a display system 300. The control system 30 includes the in-vehicle monitor 8, the position sensor 9, the inclination sensor 10, the posture sensor 11, and the control device 12. The control device 12 controls the excavator 1. The control device 12 includes a computer system.

The control device 12 includes a construction data storage unit 15, a vehicle body data storage unit 16, an operation data acquisition unit 17, an input data acquisition unit 18, a sensor data acquisition unit 19, a position/azimuth calculation unit 20, an inclination angle calculation unit 21, a working equipment position calculation unit 22, a virtual wall setting unit 23, a display control unit 24, an alarm control unit 25, a traveling control unit 26, a swing control unit 27, and a working equipment control unit 28.

The construction data storage unit 15 stores a design surface defined in the work site. The design surface is created by a computer system existing outside the excavator 1. The design surface is created in an external facility of the excavator 1, such as a design room. The design surface is a surface defined in the site coordinate system. Target terrain data of the work site is defined by a plurality of design surfaces. The excavator 1 constructs the work site based on the target terrain data.

In addition, the construction data storage unit 15 stores the virtual wall 13. The virtual wall 13 is defined by a plurality of design surfaces. The virtual wall 13 stored in the construction data storage unit 15 is created by the computer system existing outside the excavator 1. The virtual wall 13 is created in an external facility of the excavator 1, such as a design room. In the following description, the virtual wall 13 that is created outside the excavator 1 and is stored in the construction data storage unit 15 is appropriately referred to as an existing virtual wall 13A.

The vehicle body data storage unit 16 stores vehicle body data of the excavator 1. The vehicle body data of the excavator 1 includes dimensions of the working equipment 5. The dimensions of the working equipment 5 include a length of the boom 5A, a length of the arm 5B, and a length of the bucket 5C. In addition, the vehicle body data of the excavator 1 includes dimensions of the traveling body 3 and dimensions of the swing body 4.

The operation data acquisition unit 17 acquires operation data generated by operating the operating device 7.

The input data acquisition unit 18 acquires input data generated by operating the input device 8B.

The sensor data acquisition unit 19 acquires detection data of the position sensor 9, detection data of the inclination sensor 10, and detection data of the posture sensor 11.

The position/azimuth calculation unit 20 calculates a position and an azimuth angle of the swing body 4 in the site coordinate system based on the detection data of the position sensor 9. As described above, the position sensor 9 includes the GNSS receiver that receives GNSS radio waves. The position/azimuth calculation unit 20 calculates the position and the azimuth angle of the swing body 4 based on the GNSS radio waves. The azimuth angle of the swing body 4 is, for example, an azimuth angle of the swing body 4 based on the Xg axis.

The position/azimuth calculation unit 20 calculates the position of the swing body 4 based on at least one of the first measured position detected by the first position sensor 9A and the second measured position detected by the second position sensor 9B. The position/azimuth calculation unit 20 calculates the azimuth angle of the swing body 4 based on a relative position between the first measured position detected by the first position sensor 9A and the second measured position detected by the second position sensor 9B.

The inclination angle calculation unit 21 calculates an inclination angle of the swing body 4 based on the detection data of the inclination sensor 10. The inclination angle of the swing body 4 includes a roll angle and a pitch angle of the swing body 4. The roll angle refers to an inclination angle of the swing body 4 in an inclination direction around the Xg axis. The pitch angle refers to an inclination angle of the swing body 4 in an inclination direction around the Yg axis. The inclination angle calculation unit 21 calculates the roll angle and the pitch angle of the swing body 4 based on the detection data of the inclination sensor 10.

The working equipment position calculation unit 22 calculates a position of the working equipment 5 in the site coordinate system based on the vehicle body data of the excavator 1 stored in the vehicle body data storage unit 16, the position and the azimuth angle of the swing body 4 calculated by the position/azimuth calculation unit 20, the inclination angle of the swing body 4 calculated by the inclination angle calculation unit 21, and the detection data of the posture sensor 11. The position of the working equipment 5 includes the position of the bucket 5C.

The virtual wall setting unit 23 sets a virtual wall 13 to be newly added. In the following description, the virtual wall 13 to be newly added is appropriately referred to as a new virtual wall 13B.

The virtual wall setting unit 23 sets the new virtual wall 13B based on the input data from the input device 8B. The operator of the excavator 1 in the cab 2 can set the new virtual wall 13B by operating the input device 8B. The new virtual wall 13B is set to be added to the existing virtual wall 13A.

The display control unit 24 controls the display device 8A of the in-vehicle monitor 8. The display control unit 24 causes the display device 8A to display prescribed display data. In the embodiment, the display control unit 24 causes the display device 8A to display each of the existing virtual wall 13A and the new virtual wall 13B. The operator of the excavator 1 operates the input device 8B and sets the new virtual wall 13B while the existing virtual wall 13A is displayed on the display device 8A. The display control unit 24 causes the display device 8A to display the new virtual wall 13B together with the existing virtual wall 13A so that the new virtual wall 13B is added to the existing virtual wall 13A displayed on the display device 8A by setting the new virtual wall 13B.

The alarm control unit 25 controls the alarm device 8C of the in-vehicle monitor 8. When determining that the excavator 1 has approached the virtual wall 13, the alarm control unit 25 causes the alarm device 8C to output an alarm. The alarm control unit 25 can determine whether the excavator 1 has approached the virtual wall 13 based on the vehicle body data of the excavator 1 stored in the vehicle body data storage unit 16 and the position and azimuth angle of the swing body 4 calculated by the position/azimuth calculation unit 20. By outputting the alarm from the alarm device 8C, the operator of the excavator 1 can recognize that the excavator 1 has approached the virtual wall 13.

The traveling control unit 26 controls the traveling body 3 based on the operation data of the operating device 7 acquired by the operation data acquisition unit 17. In the embodiment, when determining that the traveling body 3 has approached the virtual wall 13, the traveling control unit 26 stops the traveling movement of the traveling body 3 so that the traveling body 3 does not pass over the virtual wall 13 even when the operating device 7 is operated.

The swing control unit 27 controls the swing body 4 based on the operation data of the operating device 7 acquired by the operation data acquisition unit 17. In the embodiment, when determining that the swing body 4 has approached the virtual wall 13, the swing control unit 27 stops the swing movement of the swing body 4 so that the swing body 4 does not pass over the virtual wall 13 even when the operating device 7 is operated.

The working equipment control unit 28 controls the working equipment 5 based on the operation data of the operating device 7 acquired by the operation data acquisition unit 17. In the embodiment, when determining that the working equipment 5 has approached the virtual wall 13, the working equipment control unit 28 stops the swing movement of the swing body 4 so that the working equipment 5 does not pass over the virtual wall 13 even when the operating device 7 is operated.

Figure 5:
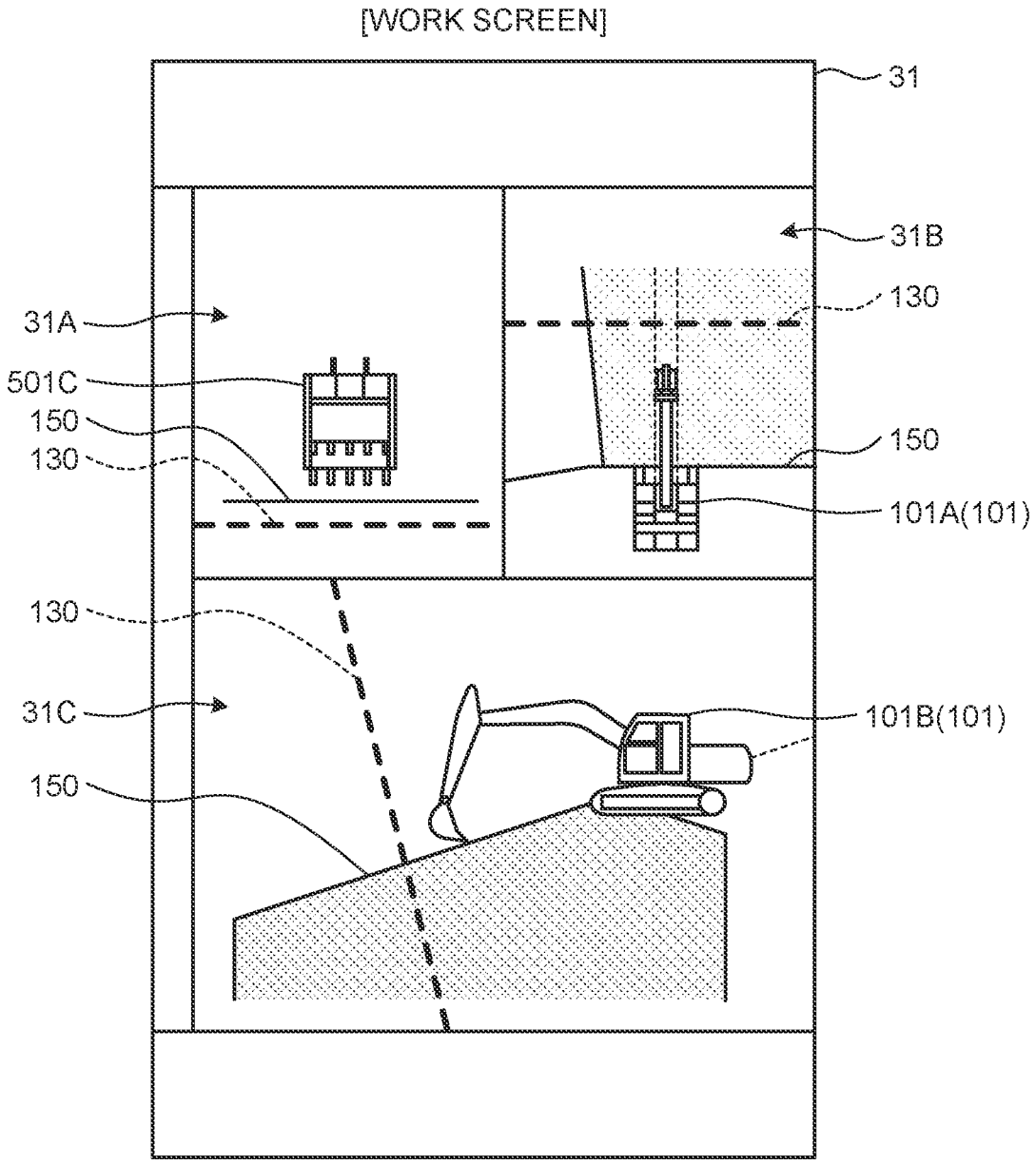
FIG. 5 is a diagram illustrating a work screen displayed on a display device according to the embodiment.

Work Screen FIG. 5 is a diagram illustrating a work screen 31 displayed on the display device 8A according to the embodiment. While the excavator 1 is performing excavation work, the display control unit 24 causes the display device 8A to display the work screen 31. As illustrated in FIG. 5, a display area 31A, a display area 31B, and a display area 31C are defined on the work screen 31.

In the display area 31A, a symbol image 501C indicating the bucket 5C, a target construction surface 150 indicating the target shape of a work target, and a symbol image 130 indicating the virtual wall 13 are displayed. The symbol image 130 is displayed in a linear shape. In the display area 31A, the symbol image 501C when the bucket 5C is viewed from the rear side, the target construction surface 150, and the symbol image 130 are displayed.

In addition, a symbol image 101 indicating the excavator 1 is displayed on the work screen 31. The symbol image 101 of the excavator 1 includes a first symbol image 101A indicating the excavator 1 when the work site is viewed from above in the site coordinate system, and a second symbol image 101B indicating the excavator 1 when the work site is viewed from the side in the site coordinate system.

In the display area 31B, the first symbol image 101A indicating the excavator 1 when the work site is viewed from above, the target construction surface 150 when the work site is viewed from above, and the symbol image 130 indicating the virtual wall 13 when the work site is viewed from above are displayed.

In the display area 31C, the second symbol image 101B indicating the excavator 1 when the work site is viewed from the side, the target construction surface 150 when the work site is viewed from the side, and the symbol image 130 of the virtual wall 13 when the work site is viewed from the side are displayed.

When the operating device 7 is operated and at least one of the traveling body 3 and the swing body 4 moves, the target construction surface 150 and the symbol image 130 change on the work screen 31 in conjunction with at least one of the traveling body 3 and the swing body 4. For example, when the swing body 4 faces the south, the display area 31C displays the target construction surface 150 and the symbol image 130 when the excavator 1 is viewed from the east side. When the swing body 4 faces the east due to the swing of the swing body 4, the display area 31C displays the target construction surface 150 and the symbol image 130 when the excavator 1 is viewed from the north side.

When the operating device 7 is operated and the working equipment 5 moves, the position of the symbol image 501C and the posture of the working equipment in the symbol image 101 change on the work screen 31 in conjunction with the working equipment 5. The operator of the excavator 1 can operate the operating device 7 while checking the work screen 31 so that the bucket 5C of the working equipment 5 moves along the target construction surface 150. The display control unit 24 can assist the operation of the operator by displaying the work screen 31 on the display device 8A.

Setting Screen

Figure 6:
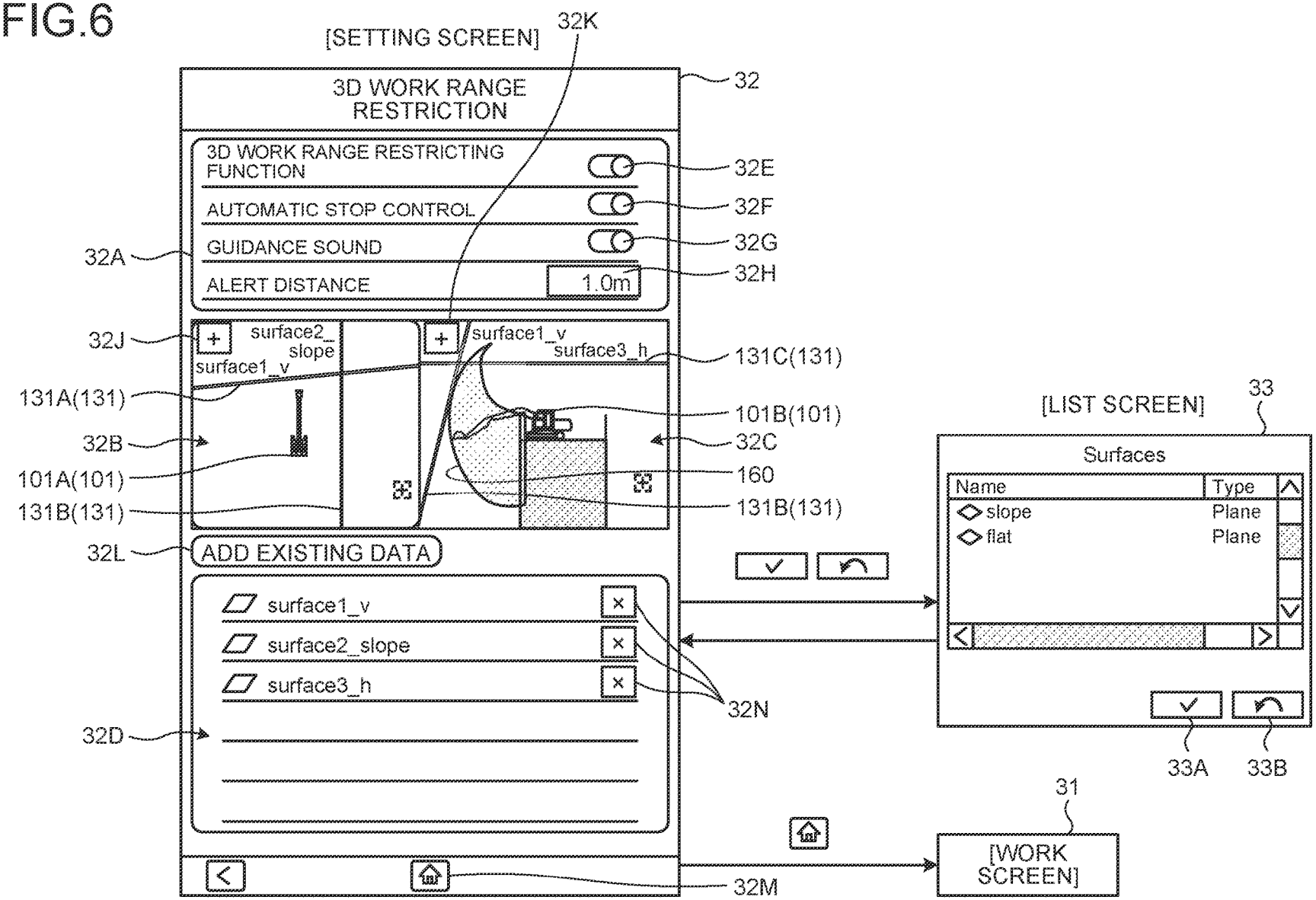
FIG. 6 is a diagram illustrating a setting screen displayed on the display device according to the embodiment.

FIG. 6 is a diagram illustrating a setting screen 32 displayed on the display device 8A according to the embodiment. In the setting related to the virtual wall 13, the display control unit 24 causes the display device 8A to display the setting screen 32. When the setting screen 32 is selected by the operator on a menu screen (not illustrated), the display control unit 24 can display the setting screen 32 on the display device 8A. Note that, when a home button 32M displayed at the lower part of the setting screen 32 is operated, the display control unit 24 causes the display data displayed on the display device 8A to transition from the setting screen 32 to the work screen 31.

As illustrated in FIG. 6, a display area 32A, a display area 32B, a display area 32C, and a display area 32D are defined on the setting screen 32.

In the display area 32A, a switch 32E, a switch 32F, a switch 32G, and an input area 32H are displayed. In addition, character data of "3D work range restricting function" is displayed to correspond to the switch 32E, character data of "automatic stop control" is displayed to correspond to the switch 32F, character data of "guidance sound" is displayed to correspond to the switch 32G, and character data of "alert distance" is displayed to correspond to the input area 32H.

The switch 32E selects whether to enable the virtual wall 13. When it is selected to enable the virtual wall 13, the symbol image 130 is displayed on the work screen 31. When it is selected not to enable the virtual wall 13, the symbol image 130 is not displayed on the work screen 31.

The switch 32F selects whether to restrict the movement of the excavator 1 when the excavator 1 has approached the virtual wall 13. When it is selected to restrict the movement of the excavator 1, the movement of the excavator 1 is restricted when the excavator 1 and the virtual wall 13 has approached each other until a distance between the excavator 1 and the virtual wall 13 becomes equal to or less than a threshold value. When it is selected not to restrict the movement of the excavator 1, the movement of the excavator 1 is not restricted even if the excavator 1 approaches the virtual wall 13.

The switch 32G selects whether to output an alarm from the alarm device 8C when the excavator 1 has approached the virtual wall 13. When it is selected to output the alarm, the alarm is output from the alarm device 8C when the excavator 1 and the virtual wall 13 has approached each other until the distance between the excavator 1 and the virtual wall 13 becomes equal to or less than the threshold value. When it is selected not to output the alarm, the alarm is not output from the alarm device 8C even if the excavator 1 approaches the virtual wall 13.

A numerical value is input to the input area 32H by operating the input device 8B. The numerical value input to the input area 32H is a threshold value related to the distance between the virtual wall 13 and the excavator 1 described above. For example, the alarm is output from the alarm device 8C when the excavator 1 approaches the virtual wall 13 until the distance between the excavator 1 and the virtual wall 13 becomes equal to or less than the threshold value input to the input area 32H.

In each of the display area 32B and the display area 32C, the symbol image 101 of the excavator 1 and a symbol image 131 indicating the currently set existing virtual wall 13A are displayed. The symbol image 131 is displayed in a linear shape. In the example illustrated in FIG. 6, the number of the currently set existing virtual walls 13A is three. Three existing virtual walls 13A are displayed as a symbol image 131A, a symbol image 131B, and a symbol image 131C. In the display area 32B, the first symbol image 101A of the excavator 1 when the work site is viewed from above, and the symbol image 131A and the symbol image 131B indicating the two existing virtual walls 13A when the work site is viewed from above are displayed. In the display area 32C, the second symbol image 101B of the excavator 1 when the work site is viewed from the side, and the symbol image 131B and the symbol image 131C indicating two existing virtual walls 13A when the work site is viewed from the side are displayed.

In addition, the display control unit 24 displays a maximum work range 160 of the working equipment 5 in the display area 32C. The maximum work range 160 of the working equipment 5 refers to a range through which the working equipment 5 passes when the working equipment 5 is moved while the working equipment 5 is extended so that a distance between the swing body 4 and the bucket 5C becomes the largest.

As described above, the virtual wall 13 is configured by a plurality of design surfaces. In the display area 32D, file names of the design surfaces configuring the currently set existing virtual wall 13A is displayed. In the example illustrated in FIG. 6, the number of the currently set existing virtual walls 13A is three. The file names of the design surfaces configuring the respective three existing virtual walls 13A are [surface1_*v*], [surface2_slope], and [surface3_*h*].

The operator can arbitrarily add or delete the design surface configuring the existing virtual wall 13A. In addition of the design surface configuring the existing virtual wall 13A, the display control unit 24 causes the display device 8A to display a list screen 33. When the operator operates an add button 32L including character data of "add existing data", the display control unit 24 can display the list screen 33 on the display device 8A. A plurality of construction surfaces stored in the construction data storage unit 15 are displayed on the list screen 33. The operator operates up and down buttons on the list screen 33 to select an arbitrary design surface, and then operates a confirmation button 33A. As a result, the selected design surface is added to the design surface configuring the existing virtual wall 13A, and is displayed in the display area 32D. In addition, the existing virtual wall 13A is generated based on the selected design surface. Note that, when a return button 33B is operated, the display control unit 24 causes the display data displayed on the display device 8A to transition from the list screen 33 to the setting screen 32.

When deleting the design surface configuring the existing virtual wall 13A, the operator operates delete buttons 32N, each of which is displayed to correspond to file names in the display area 32D of the setting screen 32. As a result, the selected design surface is deleted from the design surface configuring the existing virtual wall 13A.

The operator can create the new virtual wall 13B by operating the input device 8B. When creating the new virtual wall 13B, the operator operates at least one of a first creation button 32J displayed in the display area 32B and a second creation button 32K displayed in the display area 32C. By operating the first creation button 32J, a first creation screen 34 for creating the new virtual wall 13B when the work site is viewed from above is displayed. By operating the second creation button 32K, a second creation screen 35 for creating the new virtual wall 13B when the work site is viewed from the side is displayed.

First Creation Screen

Figure 7:
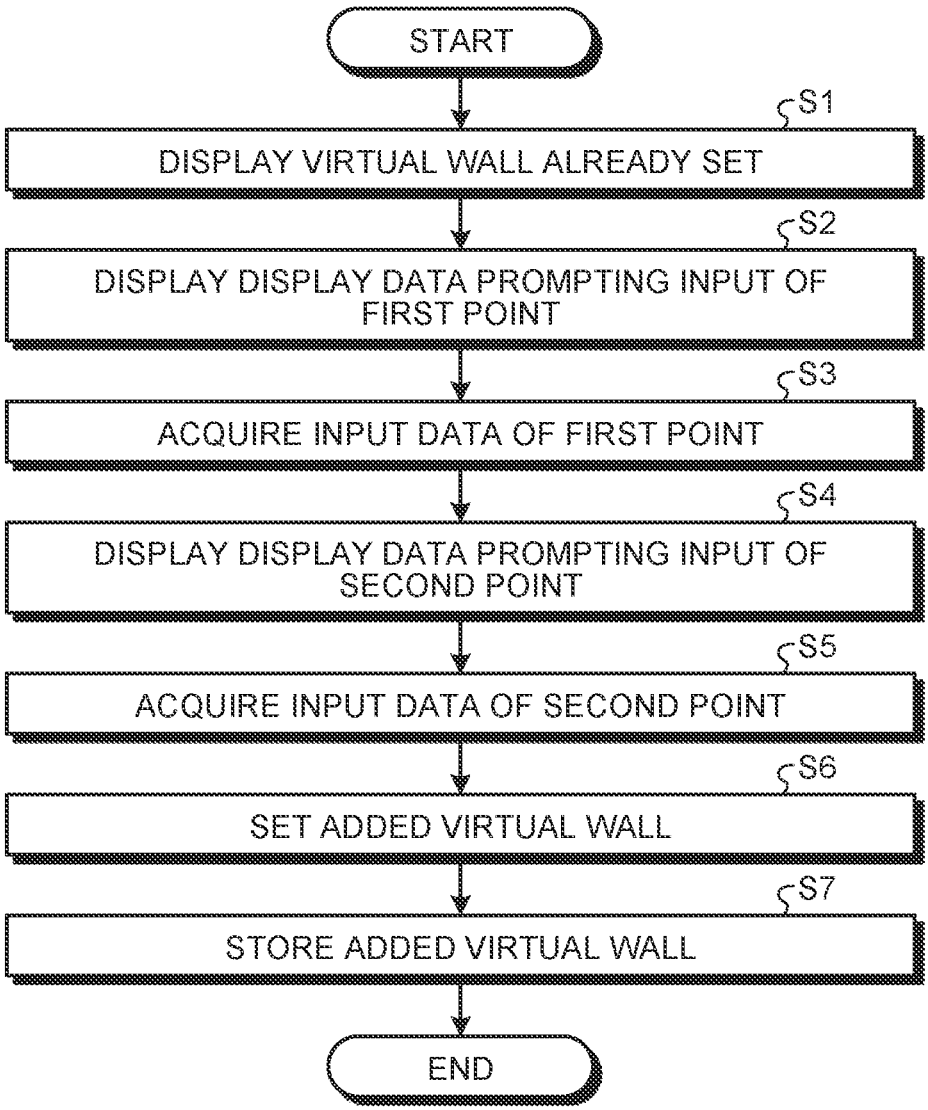
FIG. 7 is a flowchart illustrating a method of creating a new virtual wall according to the embodiment.
Figure 8:
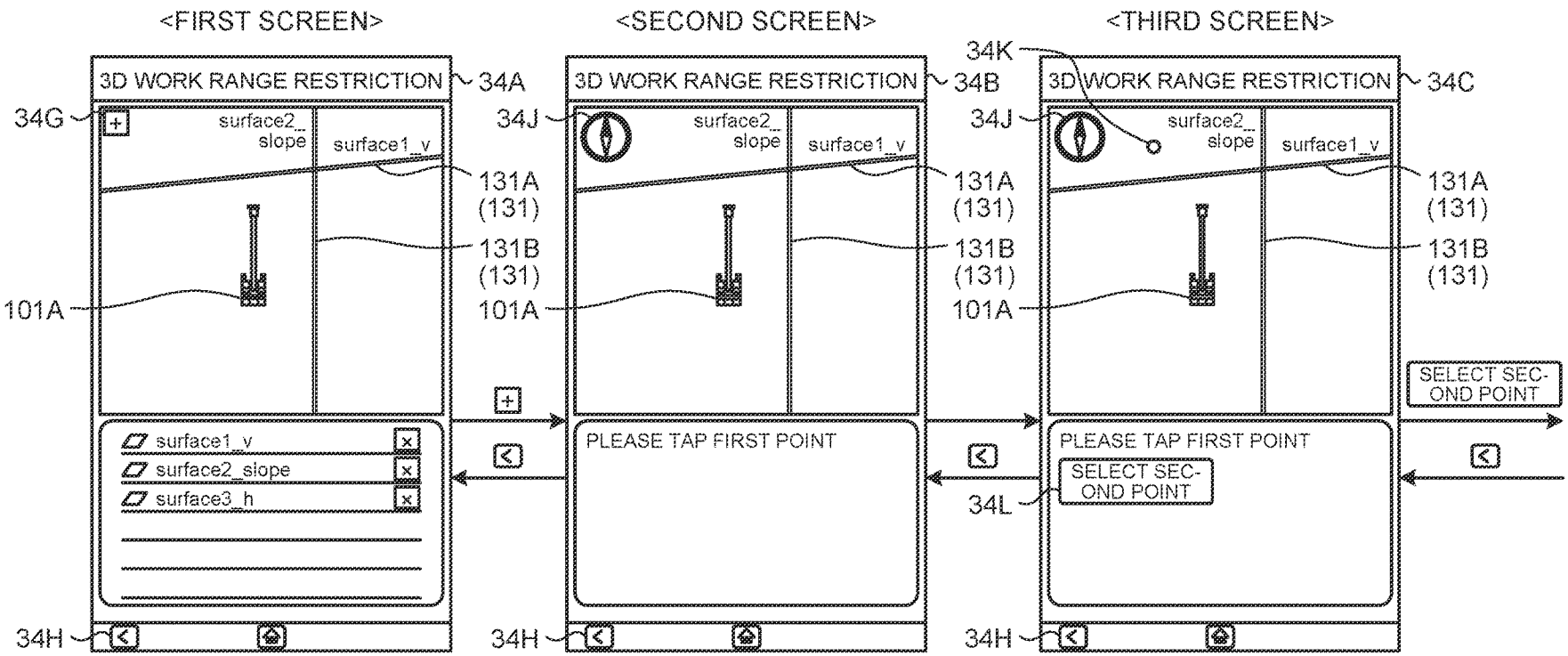
FIG. 8 is a transition diagram of a first creation screen displayed on the display device in creation of the new virtual wall according to the embodiment.
Figure 9:
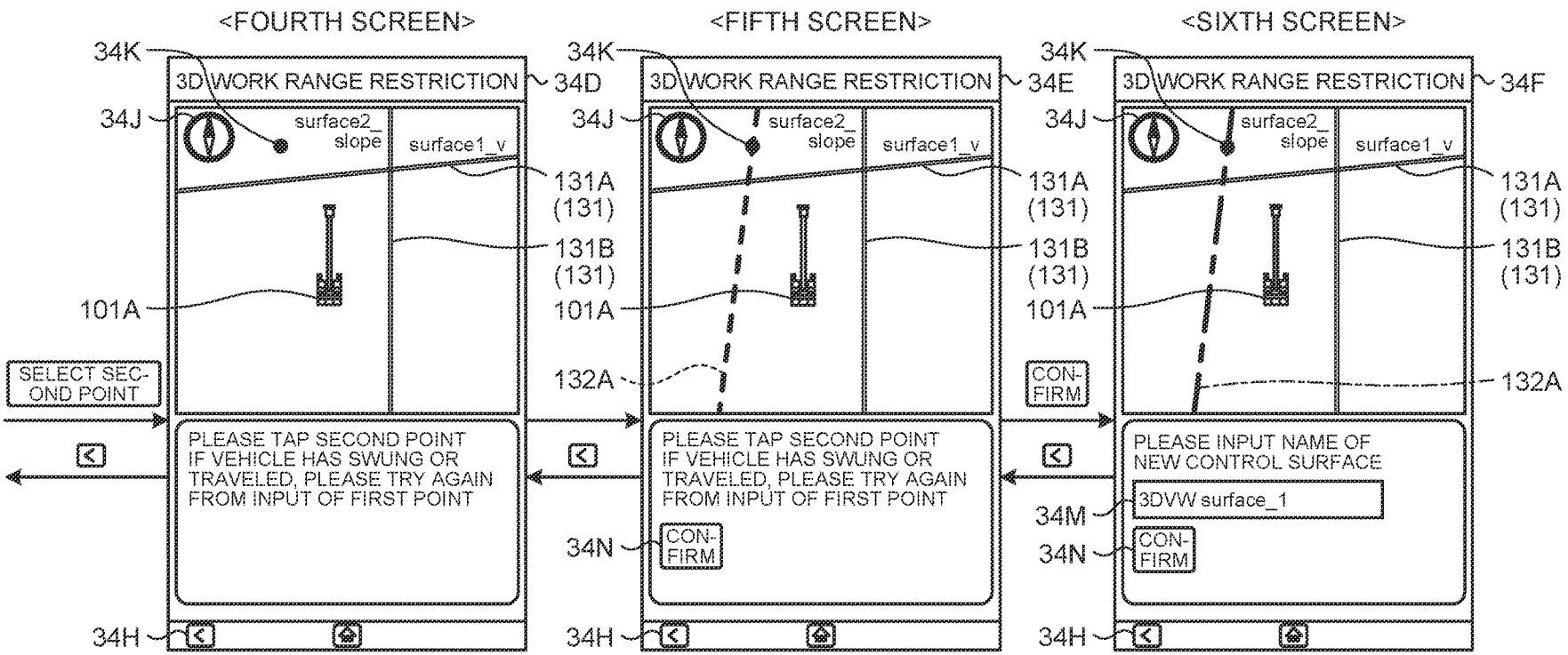
FIG. 9 is a transition diagram of the first creation screen displayed on the display device in creation of the new virtual wall according to the embodiment.

FIG. 7 is a flowchart illustrating a method of creating the new virtual wall 13B according to the embodiment. Each of FIGS. 8 and 9 is a transition diagram of the first creation screen 34 displayed on the display device 8A in the creation of the new virtual wall 13B according to the embodiment. On the first creation screen 34, the first symbol image 101A indicating the excavator 1 when the work site is viewed from above is displayed.

When the first creation button 32J is operated in the setting screen 32, the display control unit 24 causes the display device 8A to display a first screen 34A illustrated in FIG. 8. The display control unit 24 displays the existing virtual wall 13A, that is a virtual wall already set, on the first creation screen 34 (Step S1).

On the first creation screen 34, two existing virtual walls 13A when the work site is viewed from above are displayed as the symbol image 131A and the symbol image 131B.

When a button 34G is operated by the operator, the first creation screen 34 transitions from the first screen 34A to a second screen 34B, and creation of the new virtual wall 13B is started. Note that, when a button 34H is operated, the screen displayed immediately before the first screen 34A is displayed.

The new virtual wall 13B is generated by selecting two points on the first creation screen 34. The display control unit 24 causes the display device 8A to display display data prompting the input of a first point (Step S2).

On the second screen 34B, character data "please tap the first point" is displayed as the display data prompting the input of the first point. When the input device 8B includes a touch panel, the operator taps an arbitrary position on the second screen 34B. On the second screen 34B, a compass 34J indicating an azimuth is displayed. The operator can select the position of the first point while referring to the compass 34J.

The input device 8B is operated by tapping the second screen 34B. The input data acquisition unit 18 acquires input data of the first point generated by operating the input device 8B (Step S3).

When the first point is selected by the tap on the second screen 34B, the first creation screen 34 transitions from the second screen 34B to a third screen 34C. On the third screen 34C, a symbol 34K indicating the input first point is displayed. The symbol 34K has a circular shape.

On the third screen 34C, a button 34L including character data "select a second point" is displayed. When the button 34L is operated by the operator, the first creation screen 34 transitions from the third screen 34C to a fourth screen 34D. When the button 34L is operated, the first point is confirmed, and a display form of the symbol 34K changes. For example, before the button 34L is operated, the symbol 34K is displayed in yellow on the third screen 34C. After the button 34L is operated, the symbol 34K is displayed in red on the fourth screen 34D.

The display control unit 24 causes the display device 8A to display display data prompting the input of the second point (Step S4).

On the fourth screen 34D, character data "please tap the second point" is displayed as display data prompting the input of the second point. The operator taps an arbitrary position on the fourth screen 34D. The operator can select the position of the second point while referring to the compass 34J displayed on the fourth screen 34D.

Note that, when the traveling body 3 travels or the swing body 4 swings after the first point is confirmed and before the second point is selected, a relative position between the first point and the excavator 1 changes, and as a result, the virtual wall 13 generated by selecting the two points may be different from the expected virtual wall 13. Therefore, the display control unit 24 displays, on the fourth screen 34D, display data prompting re-input of the first point, such as "if the vehicle has swung or traveled, please try again from the input of the first point".

The input device 8B is operated by tapping the fourth screen 34D. The input data acquisition unit 18 acquires input data of the second point generated by operating the input device 8B (Step S5).

The virtual wall setting unit 23 sets the new virtual wall 13B indicating the newly added virtual wall 13 based on the first point and the second point selected by the operator. That is, the virtual wall setting unit 23 sets the new virtual wall 13B based on the first point input data and the second point input data acquired by the input data acquisition unit 18 (Step S6).

When the second point is selected by the tap on the fourth screen 34D, the first creation screen 34 transitions from the fourth screen 34D to a fifth screen 34E. The display control unit 24 causes the display device 8A to display a symbol image 132A indicating the new virtual wall 13B set by the virtual wall setting unit 23. The symbol image 132A has a linear shape. The display control unit 24 causes the display device 8A to display the symbol image 132A indicating the new virtual wall 13B when the work site is viewed from above.

The display control unit 24 displays each of the symbol image 131 (131A, 131B) indicating the existing virtual wall 13A and the symbol image 132A indicating the new virtual wall 13B on the fifth screen 34E.

In addition, the display control unit 24 displays the symbol image 131 (131A, 131B) indicating the existing virtual wall 13A and the symbol image 132A indicating the new virtual wall 13B in different display forms. For example, the symbol image 131 is displayed by a red solid line, and the symbol image 132A is displayed by a yellow dotted line. In addition, the symbol image 132A is displayed with a thicker line than the line of the symbol image 131.

On the fifth screen 34E, a confirmation button 34N is displayed. When the confirmation button 34N is operated, the first creation screen 34 transitions from the fifth screen 34E to a sixth screen 34F. When the confirmation button 34N is operated, the display form of the symbol image 132A changes. For example, before the confirmation button 34N is operated, the symbol image 132A is displayed as a yellow dotted line on the fifth screen 34E. After the confirmation button 34N is operated, the symbol image 132A is displayed as a red dotted line on the sixth screen 34F.

An input area 34M is displayed on the sixth screen 34F. The operator can operate the input device 8B and input the file name of the created new virtual wall 13B to the input area 34M. On the sixth screen 34F, the confirmation button 34N is displayed. After the file name is input to the input area 34M, the operator operates the confirmation button 34N, so that the added new virtual wall 13B is confirmed and stored in the construction data storage unit 15 (Step S7).

Thus, the creation of the new virtual wall 13B using the first creation screen 34 is completed.

Second Creation Screen

Figure 10:
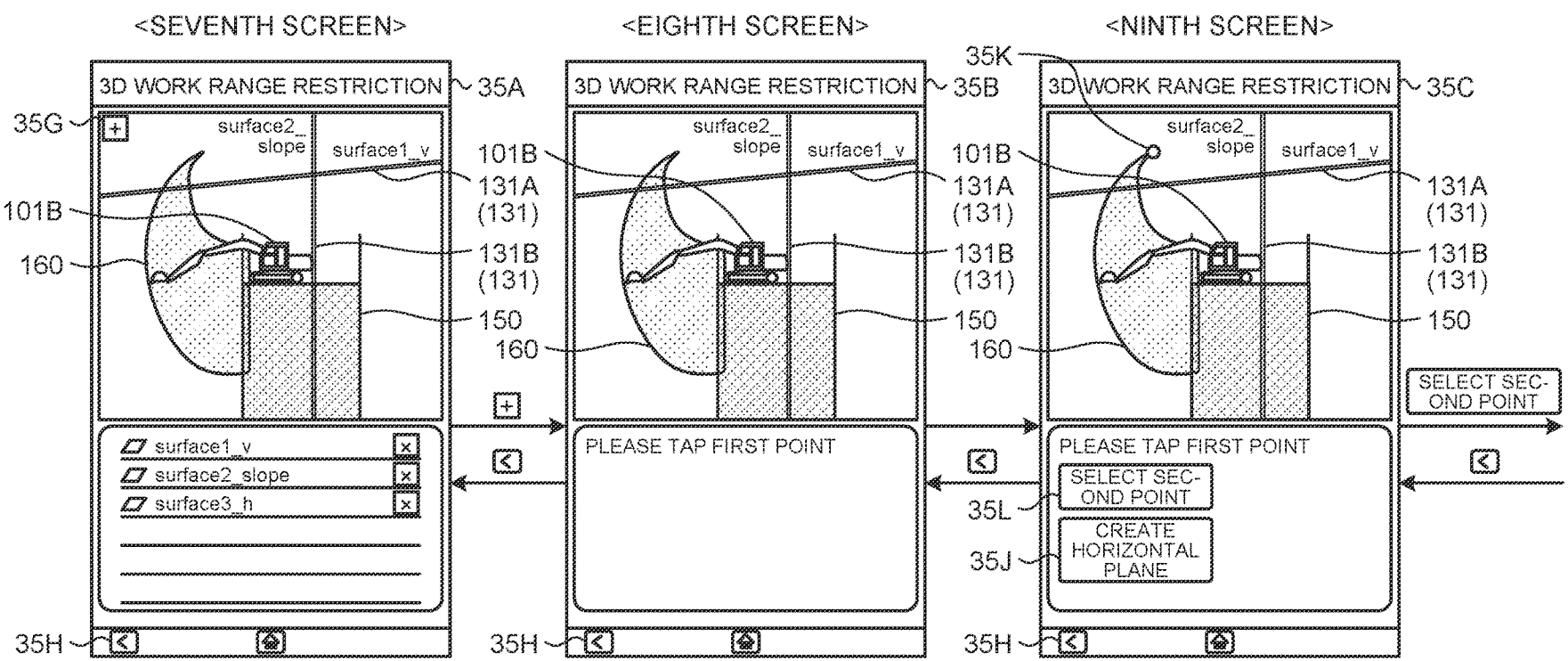
FIG. 10 is a transition diagram of a second creation screen displayed on the display device in creation of the new virtual wall according to the embodiment.
Figure 11:
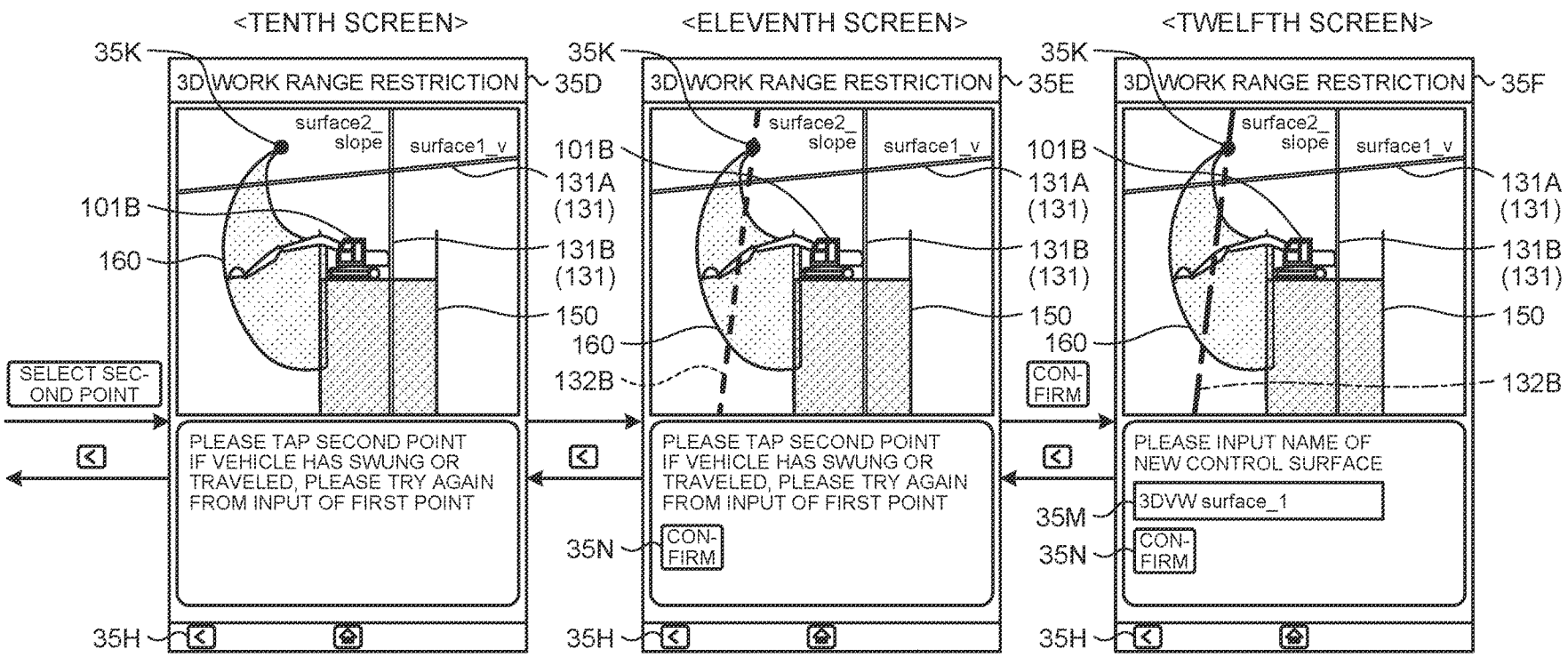
FIG. 11 is a transition diagram of the second creation screen displayed on the display device in creation of the new virtual wall according to the embodiment.
Figure 12:
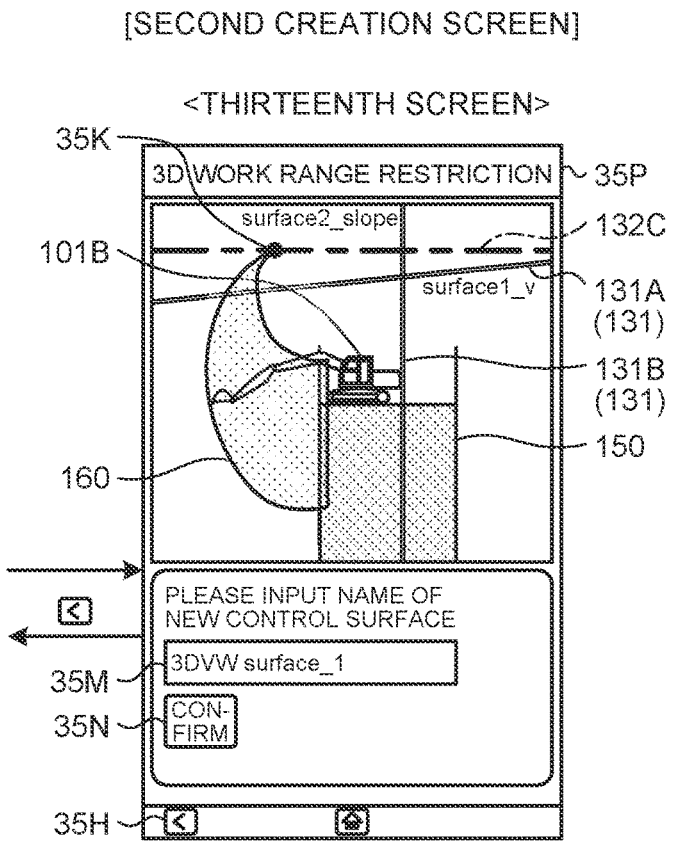
FIG. 12 is a transition diagram of the second creation screen displayed on the display device in creation of the new virtual wall according to the embodiment.

Each of FIGS. 10, 11, and 12 is a transition diagram of the second creation screen 35 displayed on the display device 8A in the creation of the new virtual wall 13B according to the embodiment. On the second creation screen 35, the second symbol image 101B indicating the excavator 1 when the work site is viewed from the side is displayed.

When the second creation button 32K is operated on the setting screen 32, the display control unit 24 causes the display device 8A to display a seventh screen 35A illustrated in FIG. 10. The display control unit 24 displays the existing virtual wall 13A, that is a virtual wall already set, on the second creation screen 35.

On the second creation screen 35, two existing virtual walls 13A when the work site is viewed from the side are displayed as the symbol image 131A and the symbol image 131B. When a button 35G is operated by the operator, the second creation screen 35 transitions from the seventh screen 35A to an eighth screen 35B, and creation of the new virtual wall 13B is started. Note that, when a button 35H is operated, the screen displayed immediately before the seventh screen 35A is displayed.

In addition, on the second creation screen 35, the display control unit 24 displays the maximum work range 160 of the working equipment 5. In addition, on the second creation screen 35, the display control unit 24 displays the target construction surface 150 indicating the target shape of a work target.

The new virtual wall 13B is generated by selecting two points on the second creation screen 35. The display control unit 24 causes the display device 8A to display display data prompting the input of the first point.

On the eighth screen 35B, character data "please tap the first point" is displayed as display data prompting the input of the first point. When the input device 8B includes a touch panel, the operator taps an arbitrary position on the eighth screen 35B. The maximum work range 160 of the working equipment 5 is displayed on the eighth screen 35B. The operator can select the position of the first point while referring to the maximum work range 160. In addition, the target construction surface 150 indicating the target shape of the work target is displayed on the eighth screen 35B. The operator can select the position of the first point while referring to the target construction surface 150.

The input device 8B is operated by tapping the eighth screen 35B. The input data acquisition unit 18 acquires input data of the first point generated by operating the input device 8B.

When the first point is selected by the tap on the eighth screen 35B, the second creation screen 35 transitions from the eighth screen 35B to a ninth screen 35C. On the ninth screen 35C, a symbol 35K indicating the input first point is displayed. The symbol 35K has a circular shape.

On the ninth screen 35C, a button 35L including character data "select a second point" is displayed. Further, on the ninth screen 35C, a button 35J including character data "select a horizontal plane" is displayed. When the button 35L is operated by the operator, the second creation screen 35 transitions from the ninth screen 35C to a tenth screen 35D. When the button 35L is operated, the first point is confirmed, and a display form of the symbol 35K changes. For example, before the button 35L is operated, the symbol 35K is displayed in yellow on the ninth screen 35C. After the button 35L is operated, the symbol 35K is displayed in red on the tenth screen 35D.

The display control unit 24 causes the display device 8A to display display data prompting the input of the second point.

On the tenth screen 35D, character data "please tap the second point" is displayed as display data prompting the input of the second point. The operator taps an arbitrary position on the tenth screen 35D. The operator can select the position of the second point while referring to the maximum work range 160 displayed on the tenth screen 35D. Further, the operator can select the position of the second point while referring to the target construction surface 150 displayed on the tenth screen 35D.

As described above, when the traveling body 3 travels or the swing body 4 swings after the first point is confirmed and before the second point is selected, a relative position between the first point and the excavator 1 changes, and as a result, the virtual wall 13 generated by selecting the two points may be different from the expected virtual wall 13. Therefore, the display control unit 24 displays, on the tenth screen 35D, display data prompting re-input of the first point, such as "if the vehicle has turned or traveled, please try again from the input of the first point".

The input device 8B is operated by tapping the tenth screen 35D. The input data acquisition unit 18 acquires input data of the second point generated by operating the input device 8B.

The virtual wall setting unit 23 sets the new virtual wall 13B indicating the newly added virtual wall 13 based on the first point and the second point selected by the operator. That is, the virtual wall setting unit 23 sets the new virtual wall 13B based on the first point input data and the second point input data acquired by the input data acquisition unit 18.

When the second point is selected by the tap on the tenth screen 35D, the second creation screen 35 transitions from the tenth screen 35D to an eleventh screen 35E. The display control unit 24 causes the display device 8A to display a symbol image 132B indicating the new virtual wall 13B set by the virtual wall setting unit 23. The symbol image 132B has a linear shape. The display control unit 24 causes the display device 8A to display the symbol image 132B indicating the new virtual wall 13B when the work site is viewed from the side.

The display control unit 24 displays each of the symbol image 131 (131A, 131B) indicating the existing virtual wall 13A and the symbol image 132B indicating the new virtual wall 13B on the eleventh screen 35E.

In addition, the display control unit 24 displays the symbol image 131 (131A, 131B) indicating the existing virtual wall 13A and the symbol image 132B indicating the new virtual wall 13B in different display forms. For example, the symbol image 131 is displayed by a red solid line, and the symbol image 132B is displayed by a yellow dotted line. In addition, the symbol image 132B is displayed with a thicker line than the line of the symbol image 131.

On the eleventh screen 35E, a confirmation button 35N is displayed. When the confirmation button 35N is operated, the second creation screen 35 transitions from the eleventh screen 35E to a twelfth screen 35F. When the confirmation button 35N is operated, the display form of the symbol image 132B changes. For example, before the confirmation button 35N is operated, the symbol image 132B is displayed as a yellow dotted line on the eleventh screen 35E. After the confirmation button 35N is operated, the symbol image 132B is displayed as a red dotted line on the twelfth screen 35F.

An input area 35M is displayed on the twelfth screen 35F. The operator can operate the input device 8B to input the file name of the created new virtual wall 13B to the input area 35M. On the twelfth screen 35F, the confirmation button 35N is displayed. After the file name is input to the input area 35M, the operator operates the confirmation button 35N, so that the added new virtual wall 13B is confirmed and stored in the construction data storage unit 15.

Note that, in the ninth screen 35C, when the button 35J including the character data of "select a horizontal plane" is operated, the second creation screen 35 transitions from the ninth screen 35C to a thirteenth screen 35P. By operating the button 35J, even if the second point is not selected, the new virtual wall 13B passing through the first point and parallel to the horizontal plane is generated. On the thirteenth screen 35P, a symbol image 132C indicating the new virtual wall 13B parallel to the horizontal plane is displayed.

Thus, the creation of the new virtual wall 13B using the second creation screen 35 is completed.

Note that, when the new virtual wall 13B is added, at least a part of the existing virtual wall 13A may be deleted.

Computer System

Figure 13:
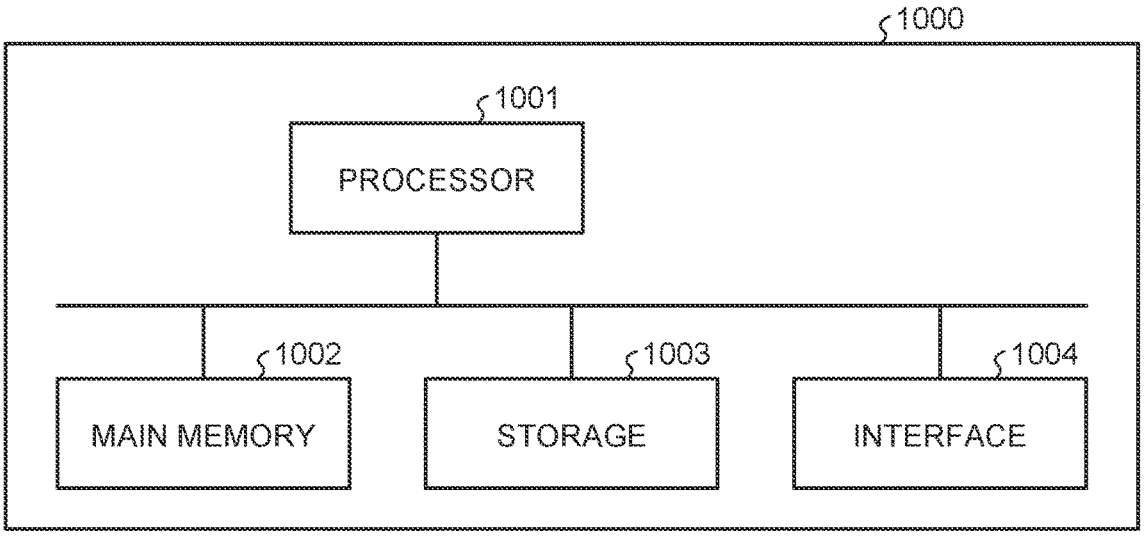
FIG. 13 is a block diagram illustrating a computer system according to the embodiment.

FIG. 13 is a block diagram illustrating a computer system 1000 according to the embodiment. The control device 12 described above includes the computer system 1000. The computer system 1000 includes a processor 1001, such as a central processing unit (CPU), a main memory 1002 including a nonvolatile memory, such as a read only memory (ROM), and a volatile memory, such as a random access memory (RAM), a storage 1003, and an interface 1004 including an input/output circuit. The function of the control device 12 described above is stored in the storage 1003 as a computer program. The processor 1001 reads the computer program from the storage 1003, loads the computer program in the main memory 1002, and executes the above-described processing according to the program. Note that the computer program may be distributed to the computer system 1000 via a network.

According to the above-described embodiment, the computer program or the computer system 1000 can execute storage of the existing virtual wall 13A indicating the virtual wall 13 that restricts the entry of the excavator 1 set at the work site of the excavator 1, setting of the new virtual wall 13B indicating a virtual wall 13 to be newly added, and display of each of the existing virtual wall 13A and the new virtual wall 13B on the display device 8A.

As described above, the display system 300 of the excavator 1 according to the embodiment includes the construction data storage unit 15 that stores the existing virtual wall 13A indicating the virtual wall 13 that restricts the entry of the excavator 1 set at the work site of the excavator 1, the virtual wall setting unit 23 that sets the new virtual wall 13B indicating a virtual wall 13 to be newly added, and the display control unit 24 that causes the display device 8A to display each of the existing virtual wall 13A and the new virtual wall 13B.

According to the embodiment, in the setting of the new virtual wall 13B, each of the existing virtual wall 13A and the new virtual wall 13B is displayed on the display device 8A, so that the operator can create the new virtual wall 13B while confirming the position of the existing virtual wall 13A. The virtual wall setting unit 23 can easily set the new virtual wall 13B.

The existing virtual wall 13A is created in advance in an external facility of the excavator 1, such as a design room. Depending on a situation of the work site, it may be desired to add the new virtual wall 13B to the existing virtual wall 13A. According to the embodiment, the virtual wall setting unit 23 can easily add the new virtual wall 13B.

The virtual wall setting unit 23 sets the new virtual wall 13B based on the input data from the input device 8B. When the input device 8B includes a touch panel, the operator can set the new virtual wall 13B at an arbitrary position only by tapping the touch panel.

The display control unit 24 causes the display device 8A to display the existing virtual wall 13A and the new virtual wall 13B in different display forms. Accordingly, in creating the new virtual wall 13B, the operator can distinguish between the existing virtual wall 13A and the new virtual wall 13B.

The display control unit 24 causes the display device 8A to display, together with the new virtual wall 13B, the first symbol image 101A indicating the excavator 1 when the work site is viewed from above and the second symbol image 101B indicating the excavator 1 when the work site is viewed from the side. As a result, the operator can create the new virtual wall 13B while confirming the relative position between the excavator 1 and the new virtual wall 13B.

The display control unit 24 causes the display device 8A to display the maximum work range 160 of the working equipment 5 included in the excavator 1. As a result, the operator can create the new virtual wall 13B while confirming the relative position between the working equipment 5 and the new virtual wall 13B.

In the above-described embodiment, each of the construction data storage unit 15, the vehicle body data storage unit 16, the operation data acquisition unit 17, the input data acquisition unit 18, the sensor data acquisition unit 19, the position/azimuth calculation unit 20, the inclination angle calculation unit 21, the working equipment position calculation unit 22, the virtual wall setting unit 23, the display control unit 24, the alarm control unit 25, the traveling control unit 26, the swing control unit 27, and the working equipment control unit 28 may be configured by separate hardware.

In the above-described embodiment, the work machine 1 is an excavator including the traveling body 3 and the swing body 4. The work machine 1 may not include the traveling body 3 and the swing body 4. The work machine 1 only needs to have a working equipment, and may be, for example, a bulldozer or a wheel loader.

The invention claimed is:

1. A display system of a work machine, the display system comprising:

a construction data storage unit configured to store an existing virtual wall indicating a virtual wall set at a work site of the work machine, the virtual wall restricting entry of the work machine;

a virtual wall setting unit configured to set a new virtual wall indicating a virtual wall to be newly added; and a display control unit configured to cause a display device to display each of the existing virtual wall and the new virtual wall the virtual wall setting unit setting the new virtual wall based on input data from an input device while the existing virtual wall is displayed on the display device.

2. The display system of the work machine according to claim 1, wherein the display control unit is configured to cause the display device to display the existing virtual wall and the new virtual wall in different display forms.

3. The display system of the work machine according to claim 1, wherein the display control unit is configured to cause the display device to display, together with the new virtual wall, a first symbol image representing the work machine when the work site is viewed from above in a site coordinate system defined at the work site and a second symbol image representing the work machine when the work site is viewed from a side in the site coordinate system.

4. The display system of the work machine according to claim 1, wherein the display control unit is configured to cause the display device to display a maximum work range of a working equipment included in the work machine.

5. The display system of the work machine according to claim 1, wherein the display control unit is configured to cause the display device to display a target construction surface indicating a target shape of a work target.

6. The display system of the work machine according to claim 1, wherein the work machine is an excavator.

7. A work machine comprising the display system of the work machine according to claim 1.

8. A display method of a work machine, the display method comprising:

storing an existing virtual wall indicating a virtual wall set at a work site of the work machine, the virtual wall restricting entry of the work machine;

causing a display device to display the existing virtual wall;

setting, based on input data from an input device, a new virtual wall indicating a virtual wall to be newly added while the existing virtual wall is displayed on the display device; and causing the display device to display each of the existing virtual wall and the new virtual wall.

9. The display method of the work machine according to claim 8, wherein the display device is configured to display the existing virtual wall and the new virtual wall in different display forms.

10. The display method of the work machine according to claim 8, wherein the display device is configured to display, together with the new virtual wall, a first symbol image representing the work machine when the work site is viewed from above in a site coordinate system defined at the work site and a second symbol image representing the work machine when the work site is viewed from a side in the site coordinate system.

11. The display method of the work machine according to claim 8, wherein the display device is configured to display a maximum work range of a working equipment included in the work machine.

12. The display method of the work machine according to claim 8, wherein the display device is configured to display a target construction surface indicating a target shape of a work target.

13. The display method of the work machine according to claim 8, wherein the work machine is an excavator.

* * * * *